US006478647B1

(12) United States Patent
Matthews

(10) Patent No.: US 6,478,647 B1
(45) Date of Patent: Nov. 12, 2002

(54) PERSONAL FLOTATION SYSTEM

(76) Inventor: Genevieve M. Matthews, 223 Monterry Dr., Victoria, TX (US) 77904

( * ) Notice: Subject to any disclaimer, the term of this patent is extended or adjusted under 35 U.S.C. 154(b) by 0 days.

(21) Appl. No.: 09/887,242

(22) Filed: Jun. 22, 2001

(51) Int. Cl.[7] ..... B63B 35/74
(52) U.S. Cl. ..... 441/129
(58) Field of Search ..... 441/129–132; 472/129; B63B 35/73, 35/74, 35/76, 35/78

(56) References Cited

U.S. PATENT DOCUMENTS 3,771,181 A 11/1973 Dansereau
4,936,804 A * 6/1990 Dowdeswell ..... 441/122
5,088,723 A 2/1992 Simmons
5,090,695 A 2/1992 Ciolino
5,324,221 A 6/1994 Kaufman et al.
D390,618 S 2/1998 Wilson
5,725,404 A 3/1998 Gomez
6,119,409 A * 9/2000 Makar et al. ..... 441/129
6,213,832 B1 * 4/2001 Fest, Sr. ..... 441/129

* cited by examiner

*Primary Examiner*—Sherman Basinger

(57) ABSTRACT

A personal flotation system for allowing a user to float in the water. The personal flotation system includes a plurality of flotation devices designed to individually support both the body and the head while the user is in the water.

1 Claim, 2 Drawing Sheets

PERSONAL FLOTATION SYSTEM

BACKGROUND OF THE INVENTION

1. Field of the Invention

The present invention relates to personal flotation systems and more particularly pertains to a new personal flotation system for allowing a user to float in the water.

2. Description of the Prior Art

The use of personal flotation systems is known in the prior art. More specifically, personal flotation systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,725,404; U.S. Pat. No. 5,324,221; U.S. Pat. No. 5,090,695; U.S. Pat. No. 5,088,723; U.S. Pat. No. 3,771,181; and U.S. Pat. No. Des. 390,618.

While these devices fulfill their respective, particular objectives and requirements, the aforementioned patents do not disclose a new personal flotation system. The inventive device includes a plurality of flotation devices designed to individually support both the body and the head while the user is in the water.

In these respects, the personal flotation system according to the present invention substantially departs from the conventional concepts and designs of the prior art, and in so doing provides an apparatus primarily developed for the purpose of allowing a user to float in the water.

SUMMARY OF THE INVENTION

In view of the foregoing disadvantages inherent in the known types of personal flotation systems now present in the prior art, the present invention provides a new personal flotation system construction wherein the same can be utilized for allowing a user to float in the water.

The general purpose of the present invention, which will be described subsequently in greater-detail, is to provide a new personal flotation system apparatus and method which has many of the advantages of the personal flotation systems mentioned heretofore and many novel features that result in a new personal flotation system which is not anticipated, rendered obvious, suggested, or even implied by any of the prior art personal flotation systems, either alone or in any combination thereof.

To attain this, the present invention generally comprises a plurality of flotation devices designed to individually support both the body and the head while the user is in the water.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being, practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new personal flotation system apparatus and method which has many of the advantages of the personal flotation systems mentioned heretofore and many novel features that result in a new personal flotation system which is not anticipated, rendered obvious, suggested, or even implied by any of the prior art personal flotation systems, either alone or in any combination thereof.

It is another object of the present invention to provide a new personal flotation system which may be easily and efficiently manufactured and marketed.

It is a further object of the present invention to provide a new personal flotation system which is of a durable and reliable construction.

An even further object of the present invention is to provide a new personal flotation system which is susceptible of a low cost of manufacture with regard to both materials and labor, and which accordingly is then susceptible of low prices of sale to the consuming public, thereby making such personal flotation system economically available to the buying public.

Still yet another object of the present invention is to provide a new personal flotation system which provides in the apparatuses and methods of the prior art some of the advantages thereof, while simultaneously overcoming some of the disadvantages normally associated therewith.

Still another object of the present invention is to provide a new personal flotation system for allowing a user to float in the water.

Yet another object of the present invention is to provide a new personal flotation system which includes a plurality of flotation devices designed to individually support both the body and the head while the user is in the water.

Still yet another object of the present invention is to provide a new personal flotation system that is compact and light.

Even still another object of the present invention is to provide a new personal flotation-system that is versatile, lending itself to be used by both adults and youths.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description marks reference to the annexed drawings wherein.

DESCRIPTION OF THE PREFERRED EMBODIMENT

Figure 1:
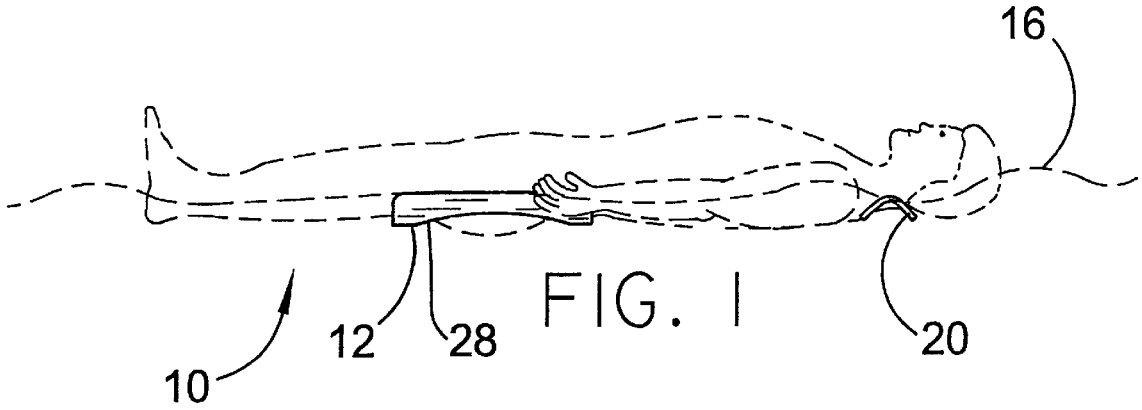
FIG. 1 is a schematic side view of a new personal flotation system in use according to the present invention.
Figure 2:
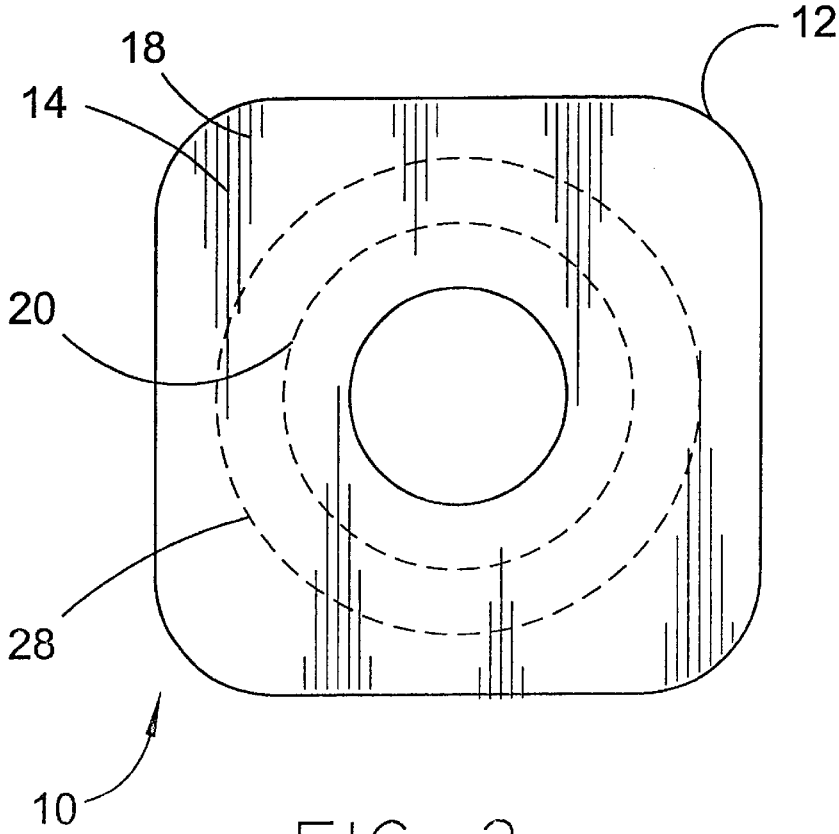
FIG. 2 is a schematic top view of the present invention.
Figure 3:
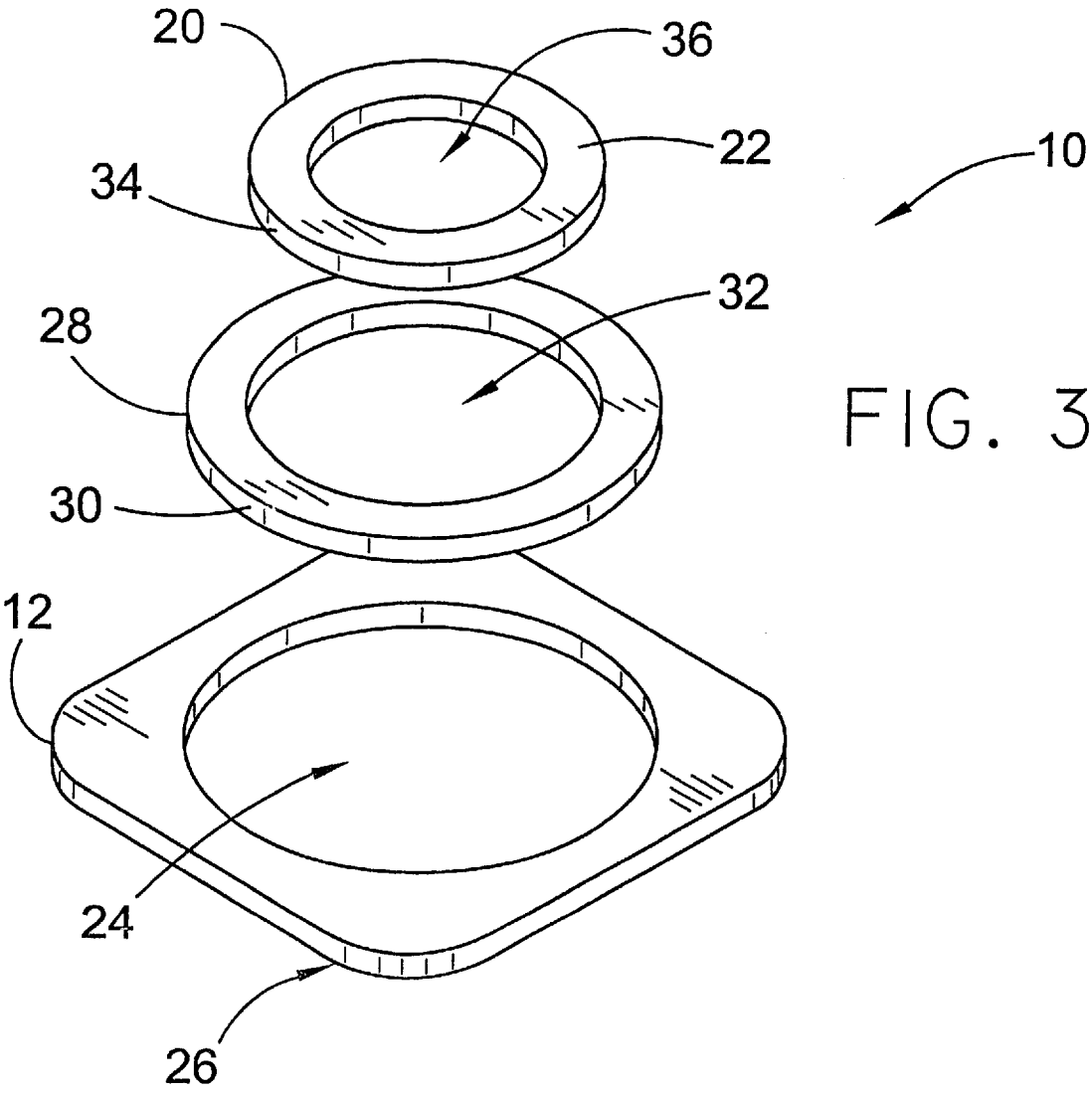
FIG. 3 is a schematic exploded perspective view of the present invention.
Figure 4:
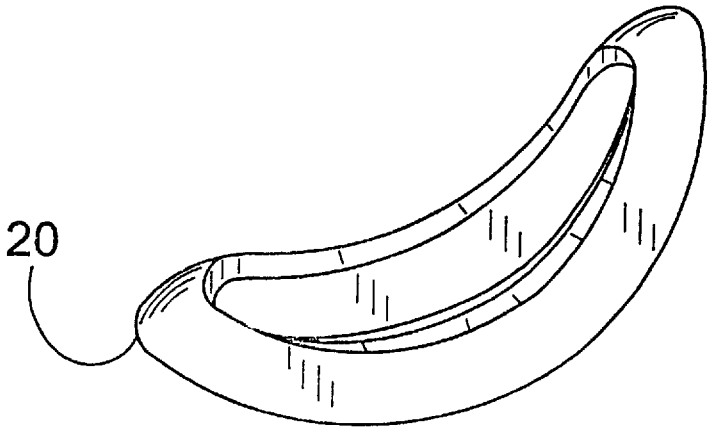
FIG. 4 is a schematic perspective view of the neck member of the present invention.

With reference now to the drawings, and in particular to FIGS. 1 through 4 thereof, a new personal flotation system embodying the principles and concepts of the present invention and generally designated by the reference numeral 10 will be described.

As best illustrated in FIGS. 1 through 4, the personal flotation system 10 generally comprises a body member 12 comprises a buoyant material 14 such that the body member 12 is designed for floating in water 16. An upper surface 18 of the body member 12 is designed for supporting a portion of a body of the user when the body member 12 and the user are in water 16.

A neck member 20 comprises the buoyant material 14 such that the neck member 20 is designed for floating in water 16. A top surface 22 of the neck member 20 is designed for supporting a head and neck of the user when the neck member 20 and the user are in water 16.

The body member 12 has an aperture 24 extending between the top surface 22 and a bottom surface 26. The aperture 24 of the body member 12 is designed for permitting a portion of the body of the user to extend through the aperture 24 for supporting, the body of the user in water 16.

The aperture 24 of the body member 12 is substantially centrally positioned in the body member 12. The body member 12 is designed for evenly supporting the portion of the body of the user contacting the top surface 22 of the body member 12 when the body member 12 and the user are in water 16.

The neck member 20 has a perimeter wall 34 that is positionable within the aperture 24 of the body member 12. The upper surface 18 of the neck member 20 is coplanar with the top surface 22 of the body member 12 for minimizing occupied space of the neck member 20 and the body member 12 when the neck member and the body member 12 are stored.

A support member 28 comprises the buoyant material 14 such that the support member 28 is designed for floating in water 16. The support member 28 is designed for supporting a portion of a body of a youth.

The support member 28 has a peripheral wall 30. The peripheral wall 30 of the support member 28 is positionable within the aperture 24 of the body member 12 such that the support member 28 is substantially coplanar with the body member 12 for minimizing occupied space of the support member 28 and the body member 12 when the neck member 20 and the body member 12 are stored.

The support member 28 has a bore 32 extending through the support member 28. The bore 32 of the support member 28 is designed for permitting the portion of the body of the youth to extend through the support member 28 for supporting the body of the youth in water 16.

The neck member 20 has a perimeter wall 34. The perimeter wall 34 of the neck member 20 is positionable within the bore 32 of the support member 28 such that the neck member 20 is substantially coplanar with the support member 28 and the body member 12 for minimizing occupied space of the neck member 20, the support member 28, and the body member 12 when the members are stored.

The neck member 20 has an orifice 36 extending through the neck member 20. The orifice 36 of the neck member 20 is designed for permitting a portion of the neck and head of the user to extend through the neck member 20 for preventing pressure points between the neck member 20 and the neck and head of the user.

The buoyant material 14 of the neck member 20 is flexible such that the neck member 20 is bendable for positioning the orifice 36 of the neck member 20 comfortably under the neck of the user.

The support member 28 has a bore 32 extending through the support member 28. The bore 32 of the support member 28 is designed for permitting the portion of the body of the youth to extend through the bore 32 of the support member 28 for supporting the body of the youth in water 16.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A personal flotation system for allowing a user to float in the water, the personal flotation system comprising:

a body member having an upper surface, said body member comprising a buoyant material such that said body member is adapted for floating in water, said upper surface of said body member being adapted for supporting a portion of a body of the user when said body member and the user are in water;

a neck member having a top surface, said neck member comprising said buoyant material such that said neck member is adapted for floating in water, said top surface of said neck member being adapted for supporting a head and neck of the user when said neck member and the user are in water;

said body member having an aperture extending between said upper surface and a lower surface, said aperture of said body member being adapted for permitting a portion of the body of the user to extend through said aperture for supporting the body of the user in water;

said aperture of said body member being substantially centrally positioned in said body member, said body member being adapted for evenly supporting the portion of the body of the user contacting said upper surface of said body member when said body member and the user are in water;

a support member comprising said buoyant material such that said support member is adapted for floating in water, said support member being adapted for supporting a portion of a body of a youth;

said support member having a peripheral wall, said peripheral wall of said support member being positionable within said aperture of said body member such that said support member is substantially coplanar with said body member for minimizing occupied space of said support member and said body member when said neck member and said body member are stored;

said support member having a bore extending through said support member, said bore of said support member being adapted for permitting the portion of the body of the youth to extend through said bore of said support member for supporting the body of the youth in water;

said neck member having a perimeter wall, said perimeter wall of said neck member being positionable within said bore of said support member such that said neck member is substantially coplanar with said support member and said body member for minimizing occupied space of said neck member, said support member and said body member when said neck member, said support member and said body member are stored;

said neck member having an orifice extending through said neck member, said orifice of said neck member being adapted for permitting a portion of the neck and head of the user to extend through said neck member for preventing pressure points between said neck member and the neck and head of the user, said buoyant material of said neck member being flexible such that said neck member is bendable for positioning said orifice of said neck member comfortably around the neck of the user.

* * * * *